US008875944B2

(12) United States Patent
Shiotani et al.

(10) Patent No.: US 8,875,944 B2
(45) Date of Patent: Nov. 4, 2014

(54) BEVERAGE DISPENSER

(75) Inventors: Nana Shiotani, Fukuchiyama (JP); Masaru Shiotani, Fukuchiyama (JP)

(73) Assignee: Kabushiki Kaisha Cosmo Life, Hyogo (JP)

( * ) Notice: Subject to any disclaimer, the term of this patent is extended or adjusted under 35 U.S.C. 154(b) by 86 days.

(21) Appl. No.: 13/255,944

(22) PCT Filed: Jun. 23, 2009

(86) PCT No.: PCT/JP2009/061386
§ 371 (c)(1),
(2), (4) Date: Nov. 21, 2011

(87) PCT Pub. No.: WO2010/116544
PCT Pub. Date: Oct. 14, 2010

(65) Prior Publication Data

US 2012/0055953 A1 Mar. 8, 2012

(30) Foreign Application Priority Data

Mar. 30, 2009 (JP) ..... 2009-081655

(51) Int. Cl.
*B67D 1/00* (2006.01)
*B67D 7/14* (2010.01)
*B67D 3/00* (2006.01)

(52) U.S. Cl.
CPC ..... *B67D 3/0032* (2013.01); *B67D 3/0022* (2013.01); *B67D 3/0038* (2013.01); *B67D 3/0009* (2013.01)
USPC ..... 222/67; 222/185.1; 222/68; 222/64; 141/352

(58) Field of Classification Search
CPC .. B65D 3/0032; B65D 3/0009; B65D 3/0038; B65D 3/0022
USPC ..... 222/68, 67, 105, 146.1, 146.5, 185.1, 222/69, 62, 482, 481.5; 220/592.18; 141/199, 204, 212, 213, 363, 364, 82, 141/59, 95
See application file for complete search history.

(56) References Cited

U.S. PATENT DOCUMENTS 1,874,858 A * 8/1932 Beckwith et al. ..... 137/400
5,035,346 A * 7/1991 Kalman ..... 222/68

(Continued)

FOREIGN PATENT DOCUMENTS

JP 1-134098 9/1989
JP 2003-128194 5/2003

(Continued)

OTHER PUBLICATIONS

International Search Report issued Aug. 4, 2009 in International (PCT) Application No. PCT/JP2009/061386.

*Primary Examiner* — Paul R Durand
*Assistant Examiner* — Jeremy W Carroll
(74) *Attorney, Agent, or Firm* — Wenderoth, Lind & Ponack, L.L.P.

(57) ABSTRACT

A beverage dispenser is proposed which includes a soft raw water container and which makes it possible to spontaneously use up drinking water in the container. A water passage tube (12) of a container connecting portion (10) includes a tubular partitioning wall (13) dividing the interior of the water passage tube (12) into a water passage (14) communicating with a water passage hole (14*a*), and an air passage (15) communicating with the water passage (14) through a small air passage hole (15*a*). A water passage pipe (16) is connected to the water passage (14). The water passage tube (12) has a base portion (12*a*) formed with an opening (15*b*) communicating with the air passage (15). An air passage pipe (17) is connected to the opening (15*b*) and hangs vertically downwardly into a low-temperature tank (2). An on-off valve (19*b*) is provided at the free end of the air passage pipe (17) which is adapted to open when the water level in the low-temperature tank (2) lowers. With this arrangement, when drinking water in the raw water container (A) runs low and the water level in the low-temperature tank (2) remains low, air in the low-temperature tank (2) is introduced into the raw water container (A) through the on-off valve (19*b*), which is now open, the air passage pipe (17), the air passage (15) and the small air passage hole (15*a*). This eliminates a negative pressure in the raw water container (A), thereby allowing water remaining in the container to be dropped into the tank.

11 Claims, 6 Drawing Sheets

(56) References Cited

U.S. PATENT DOCUMENTS

| | | | | |
|---|---|---|---|---|
| 5,647,416 | A * | 7/1997 | Desrosiers et al. | 141/351 |
| 6,648,180 | B2 * | 11/2003 | Moon et al. | 222/185.1 |
| 6,772,807 | B1 * | 8/2004 | Tang | 141/352 |
| 7,051,902 | B2 * | 5/2006 | Rivard et al. | 222/69 |
| 7,775,397 | B2 * | 8/2010 | Rivard et al. | 222/69 |
| 2002/0170921 | A1 * | 11/2002 | Tan et al. | 222/67 |
| 2005/0000984 | A1 * | 1/2005 | Tan et al. | 222/67 |
| 2005/0006405 | A1 * | 1/2005 | Tang | 222/146.6 |
| 2006/0071029 | A1 * | 4/2006 | Orita | 222/185.1 |
| 2011/0215114 | A1 * | 9/2011 | Liccioni | 222/146.6 |

FOREIGN PATENT DOCUMENTS

| | | |
|---|---|---|
| JP | 2006-131277 | 5/2006 |
| JP | 2006-341915 | 12/2006 |
| JP | 2007-240117 | 9/2007 |
| JP | 2009-035322 | 2/2009 |

* cited by examiner

BEVERAGE DISPENSER

TECHNICAL FIELD

The present invention relates to a beverage dispenser for dispensing drinking water transferred from a raw water container into a tank through an outlet valve.

BACKGROUND ART

There is known a beverage dispenser comprising a raw water container for holding drinking water therein, a container connecting portion to which the outlet port of the raw water container can be connected with the outlet port facing downward, a tank provided under the connecting portion for holding drinking water dropped from the raw water container, and an outlet valve through which drinking water in the tank can be dispensed. In some of such beverage dispensers, a raw water container is used which is made of a soft material so that its side wall has flexibility (see e.g. Patent document 1).

Such a raw water container can be collapsed during transportation, so that it can be transported efficiently. During use, as drinking water in the container drops, the container is gradually collapsed under atmospheric pressure. This prevents entry of air into the container as well as foreign matter in the air such as microorganisms and thus prevents contamination of water with e.g. microorganisms.

PRIOR ART DOCUMENTS

Patent Documents

Patent document 1: JP Patent Publication 2006-131277A

SUMMARY OF THE INVENTION

Object of the Invention

If a soft raw water container as described is used in a beverage dispenser, as the drinking water in the container runs low, the rigidity of the collapsed side wall will eventually increases to such an extent that the side wall cannot be collapsed any further. This generates a negative pressure in the container, making it impossible to drop the remaining drinking water in the container into the tank. Thus, it is impossible to use up drinking water in the container, at least not automatically.

In order to transfer such water remaining in the container into the tank, it is necessary to lift the raw water container until its outlet port separates from the container connecting portion, and incline the container to admit air into the container, thereby eliminating the negative pressure in the container. has to be the drinking water But since the raw water container is located at a high level, it is difficult to lift the container in a stable manner. Also, drinking water may spill around the container connecting portion.

An object of the present invention is to provide a beverage dispenser including a soft raw water container which makes it possible to spontaneously use up drinking water in the container.

Means to Achieve the Object

In order to achieve this object, the present invention provides a beverage dispenser comprising a raw water container for holding drinking water therein, the container having an outlet port, a container connecting portion to which the outlet port of the raw water container can be connected with the outlet port facing downward, a tank provided under the connecting portion for holding drinking water dropped from the raw water container, an outlet valve through which drinking water in the tank can be dispensed, a water passage tube provided at the container connecting portion and inserted upwardly into the outlet port of the raw water container, the water passage tube being formed with a water passage hole through which drinking water in the raw water container passes and which has a first opening at a bottom end portion thereof, a water passage pipe which is connected the first opening and through which drinking water drops into the tank, and a first on-off valve provided at a free end of the water passage pipe and configured to open when the water level in the tank lowers, wherein the raw water container has a side wall which is sufficiently flexible such that as drinking water in the container drops, the container is gradually collapsed under atmospheric pressure, wherein the interior of the water passage tube has a cross-section which is partitioned into a water passage through which the water passage hole communicates with the first opening, and an air passage communicating with a small air passage hole which opens to the water passage or the interior of the outlet port and having a second opening at a lower end portion of the air passage, and wherein the beverage dispenser further comprises an air passage pipe connected to the second opening and hanging into the tank, and a second on-off valve provided at a free end of the air passage pipe and configured to open when the water level in the tank lowers.

With the arrangement wherein the interior of the water passage tube has a cross-section which is partitioned into a water passage through which the water passage hole communicates with the first opening, and an air passage communicating with a small air passage hole which opens to the water passage or the interior of the outlet port and having a second opening at a lower end portion of the air passage, and wherein the beverage dispenser further comprises an air passage pipe connected to the second opening and hanging into the tank, and a second on-off valve provided at a free end of the air passage pipe and configured to open when the water level in the tank lowers, when drinking water in the container runs low and stops dropping and as a result, the water level in the tank remains low, air in the tank is introduced into the container through the second on-off valve, which is now open, the air passage pipe, the air passage, and the small air passage hole. This eliminates the negative pressure in the container, thus allowing driving water remaining in the container to be completely dropped into the tank. Thus, it is possible to automatically and spontaneously use up drinking water in the container. Since air introduced into the container from the tank is cleaner than outer air, the interior of the container is less likely to be contaminated.

It is not clearly known why air in the tank flows into the air passage through the air passage pipe when drinking water in the container runs low and stops dropping into the tank and as a result, the water level in the tank remains low. But this is presumably because while drinking water in the container runs low and stops dropping and the pressure of the water in the container is substantially equal to the atmospheric pressure, the pressure in the air passage, which communicates with the interior of the container through the small air passage hole, tends to fluctuate, producing a difference between the pressure in container and the pressure in the air passage, and due to this pressure difference, i.e. a slight difference between the pressure in the air passage and the atmospheric pressure, drinking water in the water passage drops and thus air in the tank flows into the air passage through the air passage pipe.

Air introduced into the air passage then flows into the container and rises through the water in the container in the form of air bubbles, thus eliminating the negative pressure in the container. When the water level in the tank decreases and the on-off valve of the air passage pipe opens while enough drinking water is stored in the container, the air passage is always completely filled with water and the amount of water that drops from the air passage pipe is always identical to the amount of water supplied into the air passage through the small air passage hole. Thus, no air is admitted into the air passage. The on-off valve of the air passage pipe is necessary because without this valve, even while there is enough water in the tank, drinking water would drop little by little into the tank from the water passage pipe.

The small air passage hole should have an area which is one-fifth or less, preferably one-tenth or less, of the cross-sectional area of the air passage.

The small air passage hole should have a diameter of 3 mm or less, preferably 1.5 mm or less.

The air passage pipe is preferably a straight pipe extending vertically from the second opening into the tank so that air introduced into the air passage pipe can smoothly flow into the air passage.

To minimize the number of parts, the first and second on-off valves are preferably opened and closed by a single common float floating on the water in the tank.

Advantages of the Invention

With the beverage dispenser according to the present invention, because the interior of the water passage tube has a cross-section which is partitioned into a water passage through which the water passage hole communicates with the first opening, and an air passage communicating with a small air passage hole which opens to the water passage or the interior of the outlet port and having a second opening at a lower end portion of the air passage, and the beverage dispenser further comprises an air passage pipe connected to the second opening and hanging into the tank, and a second on-off valve provided at a free end of the air passage pipe and configured to open when the water level in the tank lowers, when drinking water in the container runs low and stops dropping and as a result, the water level in the tank remains low, air in the tank is introduced into the container through the second on-off valve, which is now open, the air passage pipe, the air passage, and the small air passage hole. This eliminates the negative pressure in the container, thus allowing driving water remaining in the container to be completely dropped into the tank. Thus, it is possible to automatically and spontaneously use up drinking water in the container. Since air introduced into the container from the tank is cleaner than outer air, the interior of the container is less likely to be contaminated.

DETAILED DESCRIPTION OF THE INVENTION

FIG. 3(*b*) is a sectional view taken along line of FIG. 3(*a*).

FIG. 5(*b*) is a sectional view taken along line V-V of FIG. 5(*a*).

BEST MODE FOR EMBODYING THE INVENTION

Figure 1:
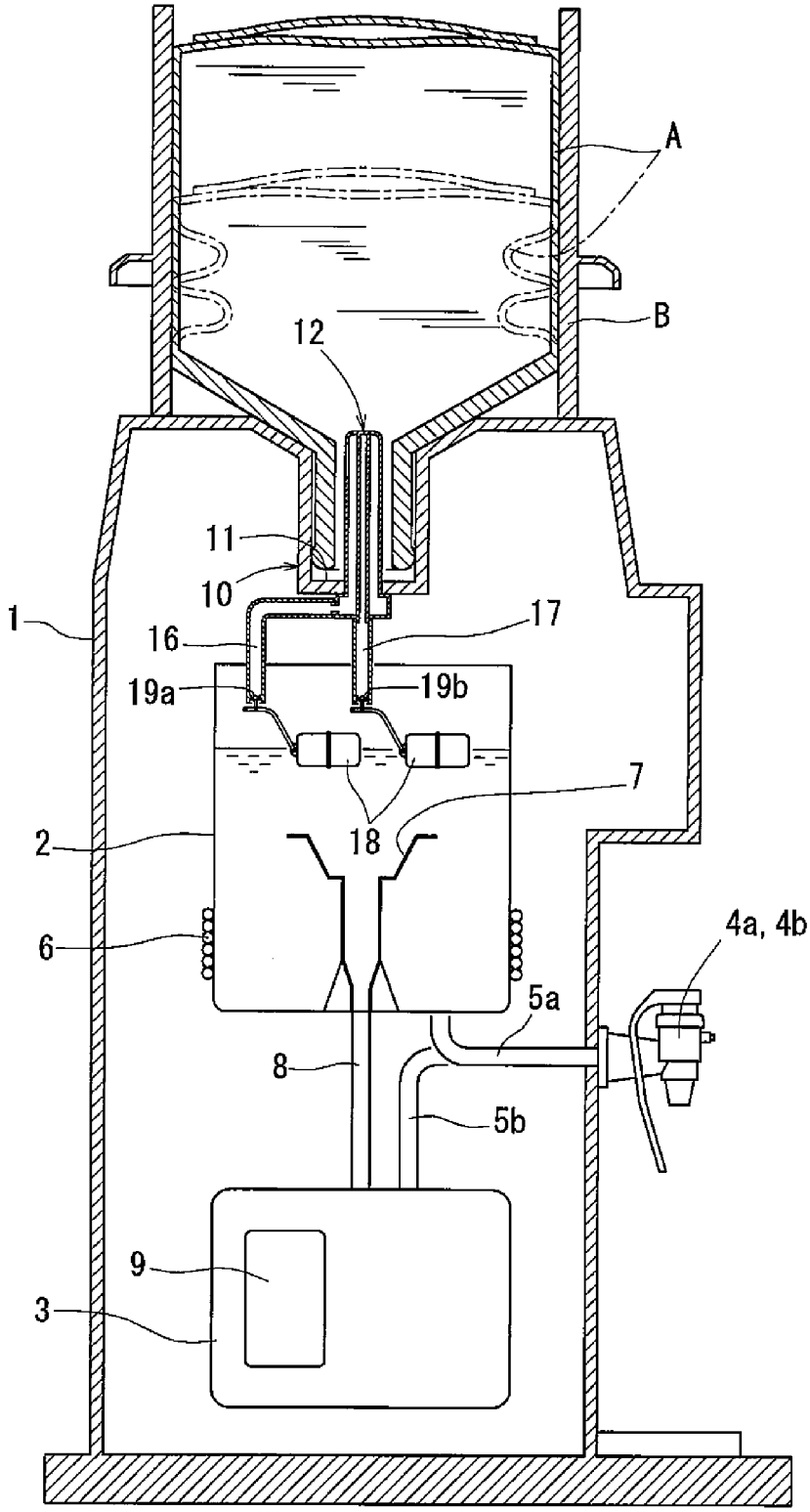
FIG. 1 is a vertical sectional view of a beverage dispenser according to a first embodiment.
Figure 2:
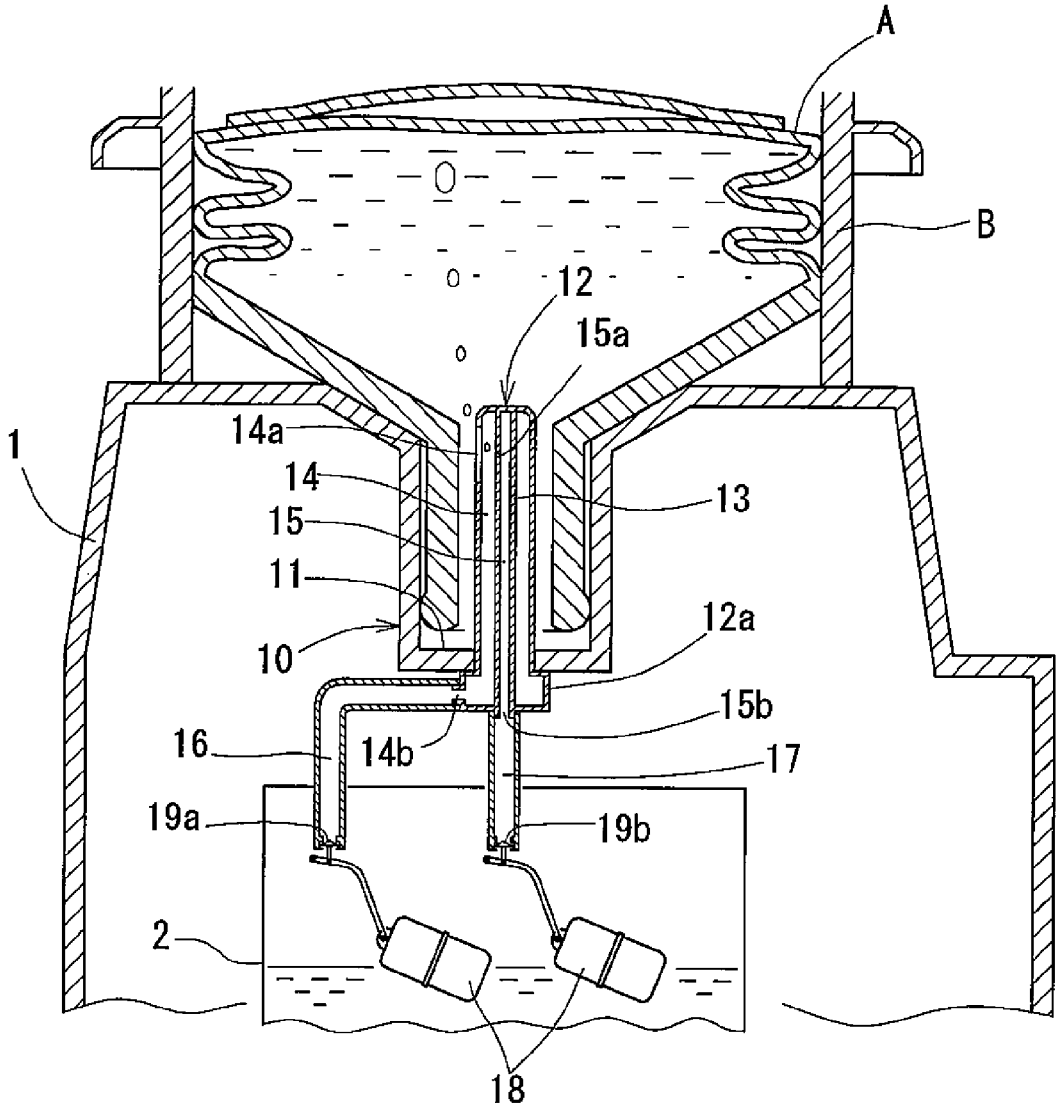
FIG. 2 is an enlarged vertical sectional view of an upper portion of FIG. 1.
Figure 3:
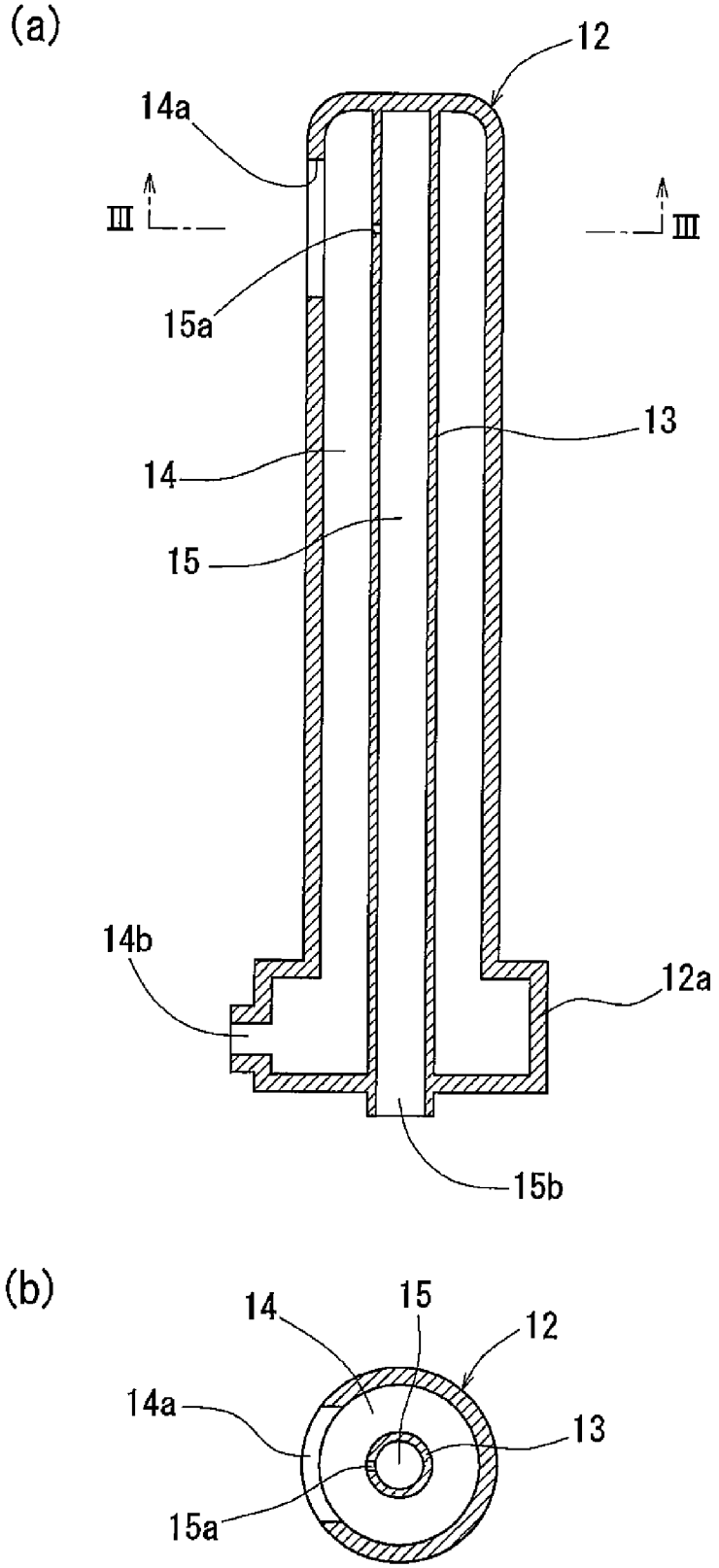
FIG. 3(*a*) is a vertical sectional view of a container connecting portion of FIG. 2.

Now embodiments of the present invention are described with reference to the drawings. FIGS. 1 to 3 show the beverage dispenser of the first embodiment, which includes, as shown in FIG. 1, a container connecting portion 10 to which an outlet port of a raw water container A, which is filled with drinking water, is connected with the container A positioned such that its outlet port faces down. The container A is made of a soft material so that its side wall has flexibility. Under the container connecting portion 10, the beverage dispenser includes a low-temperature tank 2 and a high-temperature tank 3. The dispenser further includes a casing 1 and a cold water outlet valve 4*a* and a hot water outlet valve 4*b* provided at the front wall of the casing 1 and connected to the bottom of the low-temperature tank 2 and the ceiling of the high-temperature tank 3 through outlet pipes 5*a* and 5*b*, respectively. The raw water container A, which is made of a soft material, has its outer periphery supported by a support frame B and is configured to be vertically compressed under atmospheric pressure as the drinking water in the container gradually drops from the container, as shown by the dash-dot line in FIG. 1.

A cooling device 6 is provided around the low-temperature tank 2 at its lower portion. A funnel-shaped outlet port 7 which is provided in the tank 2 at a level higher than the cooling device 6 is connected to the high-temperature tank 3 through a connecting pipe 8. Thus, water near the bottom of the tank 2, which is being cooled by the cooling device 6, is dispensed through the outlet pipe 5*a*, while relatively warm drinking water is fed to the high-temperature tank 3 through the outlet port 7. A heating device 9 is mounted in the high-temperature tank 3 for heating drinking water supplied through the connecting pipe 8. Heated drinking water in the tank 3 is dispensed through the outlet pipe 5*b*, which is connected to the ceiling of the tank 3, under the water pressure in the low-temperature tank 2.

As shown in FIGS. 1 and 2, the container connecting portion 10 has a recess 11 in which the outlet port of the raw water container A can be fitted. A water passage tube 12 extends through a central hole formed in the recess 11 and has a portion protruding upwardly from the central hole of the recess 11 and inserted upwardly into the outlet port of the raw water container A. FIG. 2 shows a state in which the side wall of the raw water container A is collapsed like a bellows with little water remaining in the raw water container A.

As shown in FIGS. 3(*a*) and 3(*b*), the water passage tube 12 includes a tubular partitioning wall 13 dividing the interior of the water passage tube 12 into a radially outer water passage 14 communicating with a water passage hole 14*a*, and a radially inner air passage 15 communicating with the radially outer water passage 14 through a small air passage hole 15*a*. The water passage tube 12 has a large-diameter base portion 12*a* at its bottom end portion that engages the bottom surface of the recess 11. The partitioning wall 13 extends to the bottom of the bottom of the base portion 12*a*. The air passage hole 15*a* has a diameter of 1.5 mm or less and has an area not more than one-tenth of the cross-sectional area of the air passage 15. The water passage hole 14*a* has a diameter of 10 mm and has an area substantially equal to the cross-sectional area of the water passage 14.

As shown in FIGS. 2, 3(*a*) and 3(*b*), an opening 14*b* is formed in the base portion 12*a* of the water passage tube 12 that communicates with the water passage 14. A water passage pipe 16 is connected to the opening 14*b*. The pipe 16 is bent so as to hang into the low-temperature tank 2. An opening 15*b* is formed in the center of the bottom of the base portion 12*a* which communicates with the air vent passage 15, which is defined by the partitioning wall 13. A straight air passage pipe 17 is connected to the opening 15*b* and vertically hangs into the low-temperature tank 2. The water passage pipe 16 and the air passage pipe 17 carry on-off valves 19*a* and 19*b* at their respective free ends that are configured to open as floats 18 in the tank 2 lowers with the fall of the water level in the tank 2.

With the raw water container A holding sufficient drinking water as shown in FIG. 1, when the water level in the low-temperature tank 2 lowers, the on-off valve 19*a* opens, allowing drinking water in the raw water container A to be supplied into the tank 2 through the water passage hole 14*a*, water passage 14 and water passage pipe 16. Thus, the water level in the tank 2 is kept constant. When the valve 19*a* opens, the on-off valve 19*b* also opens, so that a small amount of drinking water also drops through the air passage hole 15*a*, air passage 15 and air passage pipe 17.

As shown in FIG. 2, when drinking water in the raw water container A decreases and the side wall of the container A is collapsed until it cannot be collapsed any further, a negative pressure is generated in the raw water container A, so that drinking water stops dropping from the water passage pipe 16. In this state, since the water level in the low-temperature tank 2 remains low, the on-off valves 19*a* and 19*b* of the water passage pipe 16 and the air passage pipe 17 are both kept open. This allows air in the low-temperature tank 2 to be introduced into the raw water container A through the on-off valve 19*b*, air passage pipe 17, air passage 15, small air passage hole 15*a*, water passage 14 and water passage hole 14*a*, thus eliminating the negative pressure in the raw water container A. This in turn allows the drinking water remaining in the container A to be supplied into the tank 2 through the water passage pipe 16 and the air passage pipe 17 until the raw water container A is empty.

Figure 4:
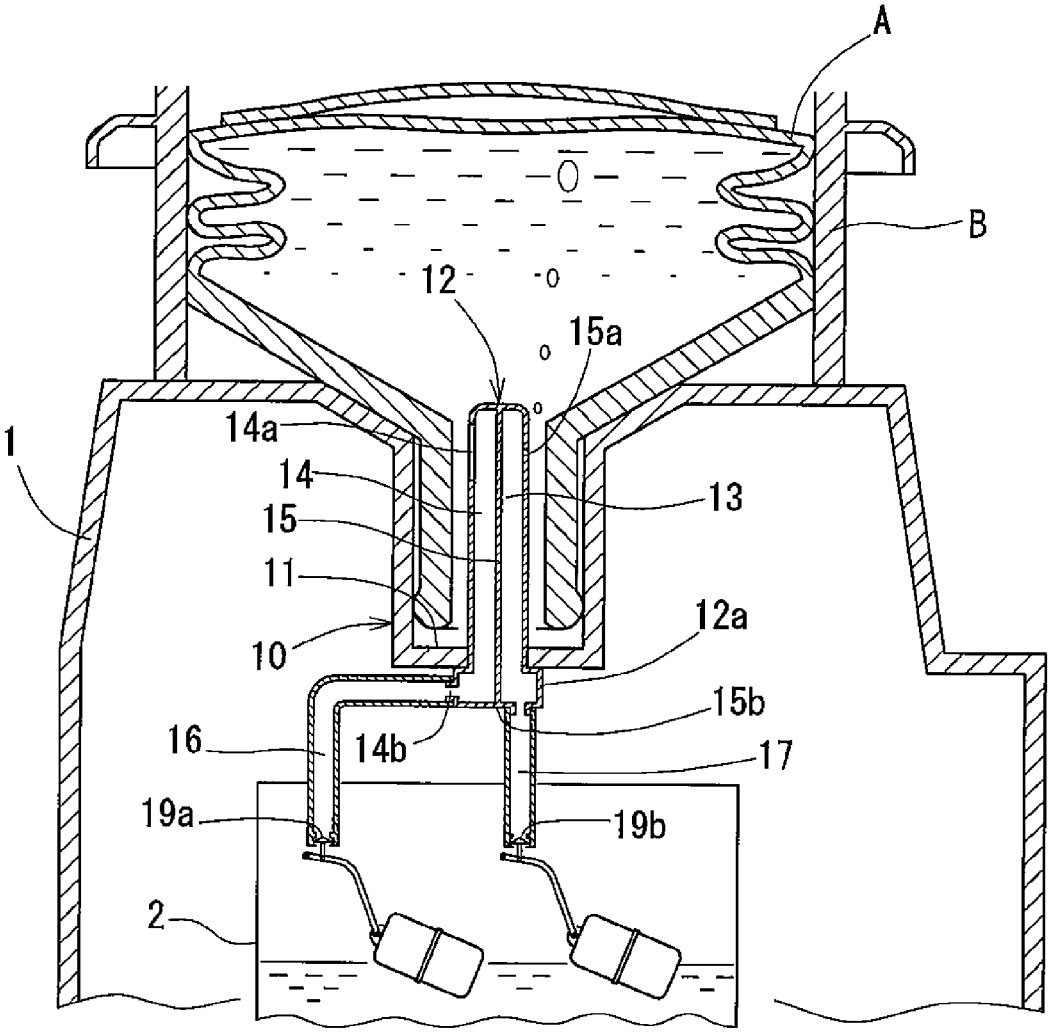
FIG. 4 is an enlarged vertical sectional view of an upper portion of a beverage dispenser according to a second embodiment.
Figure 5:
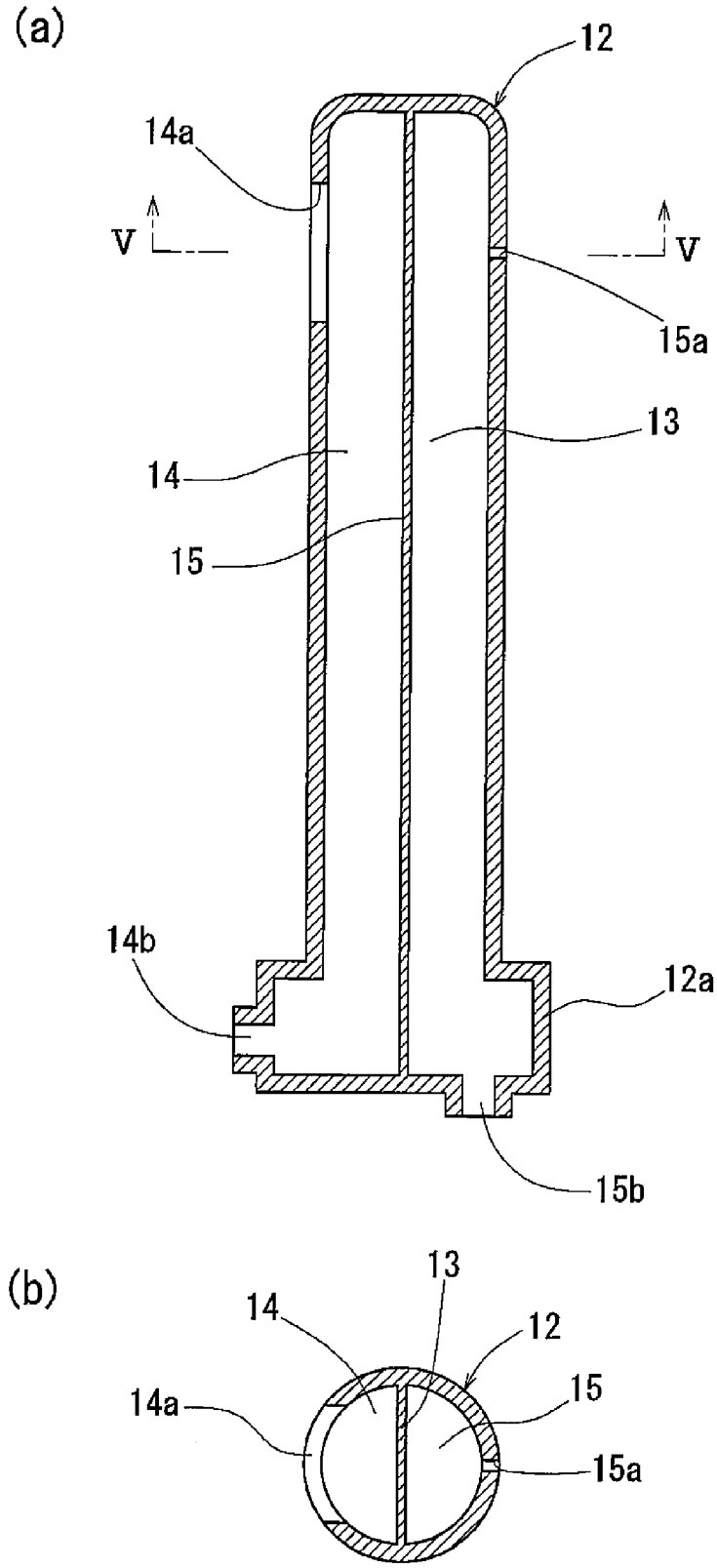
FIG. 5(*a*) is a vertical sectional view of a container connecting portion of FIG. 4.

FIGS. 4, 5(*a*) and 5(*b*) show a beverage dispenser of the second embodiment, which is basically of the same structure as the first embodiment, and differs therefrom in that the partitioning wall 13 is a flat plate dividing the interior of the water passage tube 12, which has a circular cross-section, into a water passage 14 and an air passage 15 both having a semicircular cross-section, that the air passage 15 communicates with the interior of the outlet port of the raw water container A thorough a small air passage hole 15*a*, and that the opening 15*b* of the air passage 15, to which the air passage pipe 17 is connected, is formed in the bottom of the base portion 12*a* at its portion offset to the side of the air passage 15. Otherwise, this embodiment is identical to the first embodiment. In particular, the partitioning wall 13 extends to the bottom of the base portion 12*a*, and the opening 14*b* of the water passage 14 is formed in the side of the base portion 12*a* and is connected to the water passage pipe 16. The small air passage hole 15*a* has a diameter of not more than 1.5 mm and has an area of not more than one-tenth of the cross-sectional area of the air passage 15.

In this embodiment too, as shown in FIG. 4, when drinking water in the raw water container A decreases and the side wall of the container A is collapsed until it cannot be collapsed any further, a negative pressure is generated in the raw water container A, so that drinking water stops dropping from the water passage pipe 16. In this state, since the water level in the low-temperature tank 2 remains low, the on-off valves 19*a* and 19*b* of the water passage pipe 16 and the air passage pipe 17 are both kept open. This allows air in the low-temperature tank 2 to be introduced into the raw water container A through the on-off valve 19*b*, air passage pipe 17, air passage 15, and small air passage hole 15*a*, thus eliminating the negative pressure in the raw water container A. This in turn allows the drinking water remaining in the container A to be supplied into the tank 2 through the water passage pipe 16 and the air passage pipe 17 until the raw water container A is empty.

Figure 6:
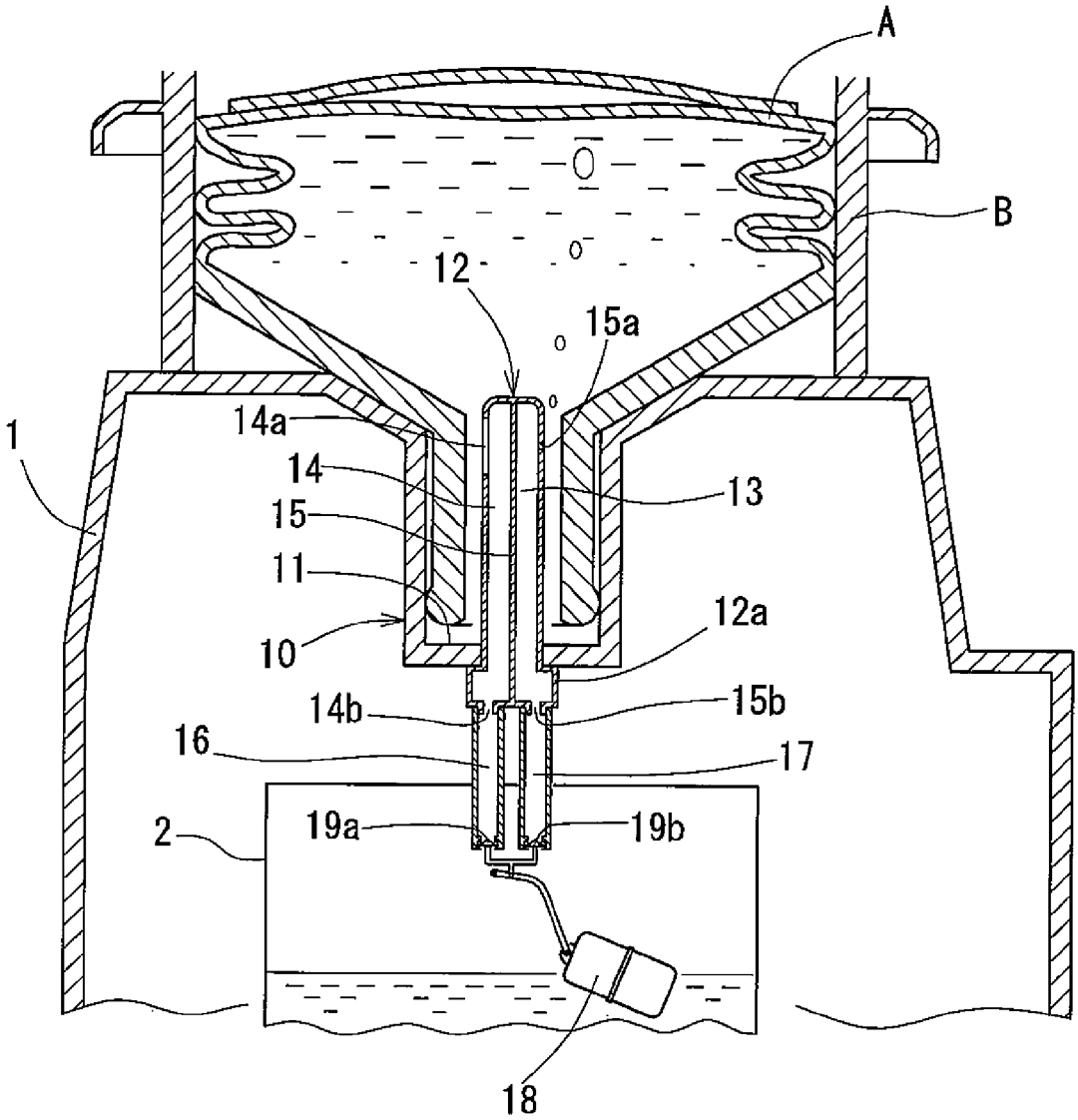
FIG. 6 is a vertical sectional view of a modification of FIG. 4.

FIG. 6 shows a modification of the second embodiment, in which the opening 14*b* of the water passage 14 and the opening 15*b* of the air passage 15 are both formed in the bottom of the base portion 12*a* of the water passage tube 12 in juxtaposition with each other. The water passage pipe 16 and the air passage pipe 17 extend vertically from the respective openings 14*b* and 15*b* in a straight line into the tank 2. The on-off valves 19*a* and 19*b* provided at the respective free ends of the water passage pipe 16 and air passage pipe 17, which are located close to each other, are opened and closed by a single float 18.

The beverage dispenser of either of the above embodiments has the low-temperature tank and the high-temperature tank, and is used to dispense water as a beverage. But the beverage dispenser may not include one of the tanks, and the beverage to be dispensed is not limited to water.

DESCRIPTION OF THE NUMERALS

A. Raw water container
B. Support frame
1. Casing
2. Low-temperature tank
3. High-temperature tank
4*a*, 4*b*. Outlet valve
5*a*, 5*b* Outlet pipe
6. Cooling device
7. Outlet port
8. Connecting pipe
9. Heating device
10. Container connecting portion
11. Recess
12. Water passage tube
12*a*. Base portion
13. Partitioning wall
14. Water passage
14*a*. Water passage hole
14*b*. Opening
15. Air passage
15*a*. Small air passage hole
15*b*. Opening
16. Water passage pipe
17. Air passage pipe
18. Float
19*a*, 19*b*. On-off valve

What is claimed is:

1. A beverage dispenser comprising:

a raw water container for holding drinking water therein, the raw water container having an outlet port;

a container connecting portion to which the outlet port of the raw water container can be connected with the outlet port facing downward;

a tank provided under the container connecting portion for holding drinking water dropped from the raw water container;

an outlet valve through which drinking water in the tank can be dispensed;

a water passage tube provided at the container connecting portion and inserted upwardly into the outlet port of the raw water container, the water passage tube being formed with a water passage hole through which drinking water in the raw water container passes, the water passage tube having a first opening at a bottom end portion thereof, wherein an interior of the water passage tube has a cross-section which is partitioned into a water passage through which the water passage hole communicates with the first opening, and an air passage communicating with a small air passage hole which opens to the water passage, the air passage having a second opening at a lower end portion of the air passage;

a water passage pipe which is connected to the first opening and through which drinking water drops into the tank;

a first on-off valve provided at a free end of the water passage pipe and configured to open when the water level in the tank lowers;

an air passage pipe connected to the second opening and hanging into the tank; and a second on-off valve provided at a free end of the air passage pipe and configured to open when the water level in the tank lowers, wherein the raw water container has a side wall which is sufficiently flexible such that as drinking water in the raw water container drops, the raw water container is gradually collapsed under atmospheric pressure.

2. The beverage dispenser of claim 1, wherein the small air passage hole has an area which is one-fifth or less of the cross-sectional area of the air passage.

3. The beverage dispenser of claim 2, wherein the air passage pipe is a straight pipe extending vertically from the second opening into the tank.

4. The beverage dispenser of claim 2, further comprising a float floating on the water in the tank and connected to the first and second on-off valves for opening and closing the first and second on-off valves.

5. The beverage dispenser of claim 1, wherein the small air passage hole has a diameter of 3 mm or less.

6. The beverage dispenser of claim 5, wherein the air passage pipe is a straight pipe extending vertically from the second opening into the tank.

7. The beverage dispenser of claim 5, further comprising a float floating on the water in the tank and connected to the first and second on-off valves for opening and closing the first and second on-off valves.

8. The beverage dispenser of claim 1, wherein the air passage pipe is a straight pipe extending vertically from the second opening into the tank.

9. The beverage dispenser of claim 8, further comprising a float floating on the water in the tank and connected to the first and second on-off valves for opening and closing the first and second on-off valves.

10. The beverage dispenser of claim 1, further comprising a float floating on the water in the tank and connected to the first and second on-off valves for opening and closing the first and second on-off valves.

11. The beverage dispenser of claim 1, wherein the outlet port of the raw water container is connected to the container connecting portion, and wherein the raw water container is arranged such that the outlet port faces downward and such that as drinking water in the raw water container drops, the raw water container is gradually collapsed under atmospheric pressure.

* * * * *